United States Patent [19]

Skrzypczak

[11] 3,947,985

[45] Apr. 6, 1976

[54] COMBINED TRASH RECEPTACLE AND ADVERTISING MEDIUM

[75] Inventor: Franz Skrzypczak, Herten, Germany

[73] Assignee: Hans Jürgen Hauser, Herten-Scherlebeck, Germany

[22] Filed: May 2, 1974

[21] Appl. No.: 466,248

[30] Foreign Application Priority Data

May 3, 1973 Germany ..... 2322243

[52] U.S. Cl. ..... 40/33; 40/77; 40/306

[51] Int. Cl.[2] ..... G09F 11/02

[58] Field of Search ..... 40/33, 77, 306, 132 R

[56] References Cited

UNITED STATES PATENTS

| | | | |
|---|---|---|---|
| 979,605 | 12/1910 | Turnpaugh | 40/33 |
| 1,424,520 | 8/1922 | Richardson et al. | 40/306 UX |
| 1,569,706 | 1/1926 | Bulwinkle | 40/132 R |
| 1,622,210 | 3/1927 | Rystedt | 40/33 |
| 1,645,870 | 10/1927 | Overton et al. | 40/132 R |
| 2,543,008 | 2/1951 | French | 40/33 |

FOREIGN PATENTS OR APPLICATIONS

| | | |
|---|---|---|
| 1,966,506 | 11/1972 | Germany |

*Primary Examiner*—William H. Grieb
*Attorney, Agent, or Firm*—Michael J. Striker

[57] ABSTRACT

A combined outdoor trash receptacle and advertising medium has a fully or partly light-transmitting outer housing which is mounted on an upright column and surrounds a hollow skeleton frame for one or more light-transmitting panels for advertising material. The frame is rotated in the housing by an electric motor which is mounted in the column, and the frame surrounds one or more lamps which are disposed around a removable trash can. The housing has a pivotable cover which enables the pedestrians to drop refuse into the can. The open top of the can is provided with a collar which rests on a seat forming part of the top portion of the housing or the top section of the frame.

19 Claims, 11 Drawing Figures

COMBINED TRASH RECEPTACLE AND ADVERTISING MEDIUM

BACKGROUND OF THE INVENTION

The present invention relates to trash receptacles in general, and more particularly to improvements in outdoor or indoor trash receptacles. Still more particularly, the invention relates to improvements in outdoor or indoor trash receptacles which can be used as advertising media by authorities and/or private parties.

U.S. Pat. No. 1,424,520 to Richardson et al. discloses a combined outdoor trash receptacle and advertising carrier which comprises a ground-supported prismatic skeleton frame made of angle iron bars and panels which are connected to the frame by screws or the like so as to constitute the four upright side walls of the outer housing for a removable trash basket which is made in part of wire mesh with large interstices. The bottom part of the basket is free of interstices and the basket diverges conically toward a cover which is pivoted to an upper horizontal bar of the skeleton frame. The basket is supported by and is freely liftable off four brackets which are secured to the frame and extend into the interior of the space between the panels. The cover resembles the frustum of a pyramid and is provided with three pivotable flaps which enable the passers-by to drop refuse into the basket without lifting the cover. The outer sides the panels carry advertising matter which is exposed to elements and is therefore damaged, contaminated or destroyed immediately or within relatively short intervals of time. Moreover, such panels are inviting targets to vandals for the application of graffiti or disfiguration of the advertising material. The panels are equally likely to be contaminated at their inner sides since the upper part of the basket permits certain types of trash to pass through the relatively large interstices and to come into direct contact with the panels so that their removal for the purpose of replacing advertising matter at the outer sides is an unpleasant task. The basket is relatively large so that portions thereof are immediatelyor closely adjacent to the inner sides of the panels. Refuse which is introduced through the openings in the coveris likely to drop between the basket and the panels so that some trash remains in the outer housing when a sanitation crew opens the cover and transfers the contents of the basket into a garbage truck.

German printed publication No. 1,966,506 discloses an elongated open receptacle of rectangular cross section which is suspended on a rectangular frame for pivotal movement about a horizontal axis. The open top of the receptacle is overlapped by a roof-shaped cover which is pivotable back and forth about a horizontal axis so that refuse can be dropped into the receptacle by pivoting the cover to either side of its neutral position. The exposed front and rear sides of the receptacle carry advertising matter which is overlapped by sheets of penetration-resistant transparent or translucent synthetic plastic sheet material. A drawback of the just described receptacle is that it can be readily detached from the frame, e.g., by playful children. Furthermore, the mounting of the receptacle is such that only two of its sides can carry advertising matter. Still further, there is no provision to prevent penetration of moisture, dust and/or foreign matter between the plastic sheets and the advertising matter therebehind so that the appearance of the advertisements is unseemly after a relatively short period of exposure to elements.

It is further known to secure a parallelepiped trash receptacle to an upright support by resorting to screws or the like, to fixedly mount the support in the ground, and to apply sheets of advertising material to the external surfaces of the receptacle. The advertising material may contain fluorescent substances. A drawback of such receptacles, which normally consist of metal, is that they are heavy and bulky and therefore difficult to handle during removal of accumulated refuse. Moreover, the externally applied advertising matter is not protected against atmospheric conditions so that its useful life is extremely short. Still further, the distance from which the advertising matter can be seen at night is minimal, even if the advertising matter contains fluorescent substances. Therefore, a negligent pedestrian is more likely to drop refuse on the street, on the sidewalk, into the entrances of buildings and/or into recesses below display windows to thus contribute to seedy appearance of the town.

U.S. Pat. No. 979,605 discloses a rotary advertising medium wherein a support for advertising matter rotates about one or more lamps. The support consists of light-transmitting material and is surrounded by a stationary housing whose material also transmits light. A drawback of such medium is that it serves no other purpose but to carry posters or other advertising matter and that its bulk is considerable. The major part of the interior of the stationary housing is not used at all.

SUMMARY OF THE INVENTION

An object of the invention is to provide a combined trash receptacle and advertising medium which can be used indoors or outdoors, which is of eye-pleasing appearance and allows convenient access to accumulated trash, which can be designed to draw attention to advertising matter, and which can also serve as a substitute for and/or as an auxiliary street illumination.

Another object of the invention is to provide a receptacle which can carry a relatively large amount of advertising material, which can store substantial quantities of trash, and which contributes to rather than detracts from the appearance of streets, buildings, shopping malls and/or other locations where it is being put to use.

A further object of the invention is to provide an outdoor trash receptacle and advertising medium wherein the displayed material is protected against the influence of rain, soot or the like in spite of the fact that the accumulated refuse and/or the advertising material can be readily reached by authorized persons.

An additional object of the invention is to provide an outdoor trash receptacle and advertising medium which is readily detectable in daylight as well as in darkness, and which protects the advertising material against vandals, thieves and/or other unauthorized persons.

The invention is embodied in a combined trash receptacle and advertising medium which comprises a support preferably constituting a hollow upright tubular column which is anchored in the ground, an upright cylindrical, polygonal, conical or pyramidal housing which has a bottom portion mounted on the support, a top portion spaced apart from the bottom portion and preferably provided with a cover or lid which tends to assume a closed position by gravity and is pivotable from such closed position to at least one open position, and a tubular intermediate portion which connects the top and bottom portions and consists (at least in part) of impact-resistant and non-flammable light-transmitting material, a frame mounted in the housing and having means for preferably removably supporting one or more panels with advertising matter so that the panel or panels are located behind the intermediate portion of the housing, a trash can which has an open top below the cover and is removably mounted in the top portion of the housing or in a top section of the frame, and means for illuminating the advertising matter on the panel or panels. If the panel or panels consist at least in part of light-transmitting material, the illuminating means includes one or more light sources (e.g., one or more upright fluorescent tubes) mounted in the frame between the panel or panels and the can.

The frame is preferably movable (most preferably rotatable) with respect to the housing and the receptacle then further comprises means for moving the frame with respect to the housing. Such moving means may include an electric motor which is preferably mounted in the support and is connected with a remote energy source by way of conductor means extending through the support. Such conductor means is preferably further connected with the light source by an electrical connection which may include one or more stationary and one or more movable contacts which are insulated against moisture. The movable contact or contacts rotate with the frame in the interior of the housing.

The novel features which are considered as characteristic of the invention are set forth in particular in the appended claims. The improved receptacle itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
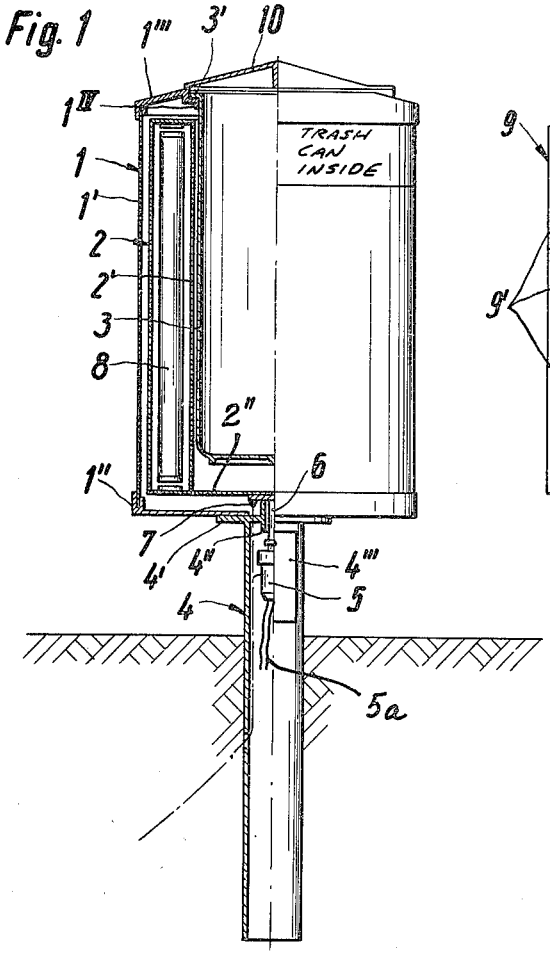
FIG. 1 is a partly elevational and partly central vertical sectional view of a receptacle which embodies one form of the invention.
Figure 2:
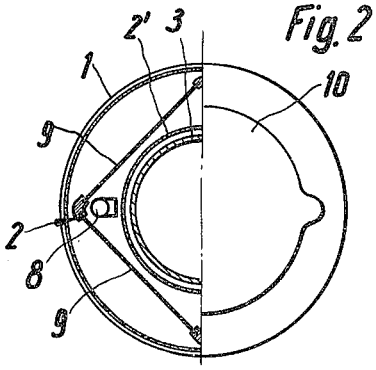
FIG. 2 is a partial plan and partial horizontal sectional view of the receptacle shown in FIG. 1.

Referring first to FIGS. 1 and 2, there is shown a combined trash receptacle and advertising medium which is designed for use outdoors, e.g., at street corners, but is equally suited for indoor use, for example, in department stores, subway stations, banks, covered shopping malls, schools, other public buildings, covered or open sports stadia, and others. The receptacle comprises a support 4 which is shown in the form of a hollow upright tubular column anchored in the ground (e.g., on a street corner) and has at its upper end an outwardly extending annular flange 4' for the horizontal disk-shaped bottom portion 1'' of an upright housing 1. The support 4 may constitute a cylindrical tube consisting of concrete or metal. The housing 1 further comprises an annular top portion 1''' which is spaced apart from the bottom portion 1'', and a cylindrical intermediate portion 1' which connects the portions 1'', 1''' and preferably consists of an impact-resistant and non-flammable synthetic plastic material which is transparent or translucent, i.e., light-transmitting. The marginal zones of the top and bottom portions 1''', 1'' of the housing 1 are preferably provided with annular grooves which sealingly receive the respective edges of the intermediate portion 1' in such a way that the edges are preferably a tight fit in the corresponding grooves. The top portion 1''' carries a cover or lid 10 which is pivotable between a closed position (shown) and at least one open position in which a passer-by can discard trash into a removable trash can 3 which is suspended in the top portion 1''' and has an open top below the cover 10. The cover 10 is preferably of the type which automatically tends to assume its closed position under the action of gravity. To this end, the central portion of the cover can be pivotably mounted on a horizontal pintle which is mounted in the top portion 1''' and is normal to the common axis of the cylindrical portion 1' and column 4. Such types of mountings for the covers of trash receptacles are well known.

The top portion 1''' of the housing 1 is formed with a centrally located recessed annular seat $1^{IV}$ which supports and centers an outwardly extending ring-shaped collar 3' surrounding the open top of the trash can 3. The term "trash can" is intended to denote all types of containers for refuse, such as flexible bags consisting of polyvinyl chloride or another suitable synthetic plastic material, rigid baskets made of wire or sheet metal, and/or others. If the cover 10 is mounted for pivotal movement about a horizontal axis which is substantially tangential to the seat $1^{IV}$, the trash can 3 can be lifted off the seat when the cover is pivoted to its fully open position. If the cover 10 is mounted in the aforedescribed manner (for pivotal movement on a pintle which intersects the axis of the intermediate portion 1'), it is preferably lifted off the top portion 1''' in order to enable the crew of a sanitation truck or the janitor of a building to remove the can in order to dump its contents into a truck or basket and to thereupon reinsert the emptied can or insert a fresh can.

The receptacle further comprises a skeleton frame 2 which is installed between the cylindrical intermediate portion 1' and the trash can 3 and has a square (i.e., polygonal) cross-sectional outline (see particularly FIG. 2). The disk-shaped bottom section 2'' of the frame 2 is rotatably mounted on a preferably removable internal flange 4'' of the support 4 and is located slightly above the bottom portion 1'' of the housing 1. The means for rotating the frame 2 comprises a small electric motor 5 which is suspended on the flange 4'' in the interior of the support 4 and has a vertical output shaft 6 which drives the bottom section 2''. A door 4''', which is normally locked, is provided in the support 4 above the ground to afford access to the motor 5.

Figure 3:
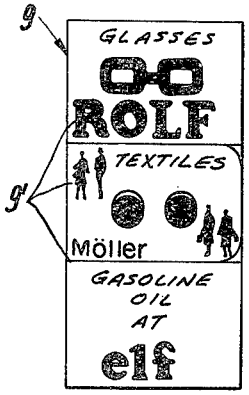
FIG. 3 is a front elevational view of a removable panel in the receptacle of FIGS. 1 and 2.

The frame 2 can support four removable panels 9 (one shown in FIG. 3) which carry advertising matter 9'. Each of these panels constitutes one side of a tubular structure having a square outline when the frame 2 supports four discrete panels. As shown in FIG. 2, the upright portions of the frame 2 are formed with vertical grooves which slidably receive the corresponding vertical edge portions of the panels 9. The panels 9 can be inserted into or removed from the frame 2 after the top portion 1''' is detached from the intermediate portion 1' of the housing 1. In the embodiment of FIGS. 1 to 3, the panels 9 consist at least in part of an impact-resistant (not readily deformable) and non-flammable light-transmitting synthetic plastic material. The advertising material 9' on these panels is illuminated by four light sources 8 which are installed in the frame 2 outwardly of the trash can 3, preferably at the four corners of the frame. The illustrated light sources 8 constitute upright fluorescent tubes which are mounted in suitable sockets provided therefor in the frame 2.

The inner flange 4'' of the support 4 carries an upwardly extending electric switch contact 7 which is insulated against moisture and engages a rotary switch contact on the bottom section 2'' of the frame 2 so as to electrically connect the lamps 8 with conductors 5a which supply energy to the motor 5. If desired, the switch which includes the contact 7 may constitute a device which connects the lamps 8 with an energy source at regular intervals when the frame 2 rotates in the housing 1 to thereby draw attention to the advertising material 9' on the panels 9. Such intermittently operating switch may include two or more discrete arcuate contacts at the underside of the bottom section 2''. When the motor 5 is on, the contact 7 engages successive arcuate contacts and thereby causes the lamps 8 to light up at desired intervals. The conductors 5*a* are provided in the support 4.

The frame 2 further carries an upright cylindrical body 2' which is disposed between the panels 9 and the trash can 3 and may constitute a reflector which directs light, issuing from the lamps 8, against the rear sides of the panels 9 in the frame 2. This body 2' may consist or may include an outer layer of aluminum foil or other suitable light-reflecting material. The cylindrical body 2' further serves as a protective shield for the lamps 8, i.e., it prevents the trash can 3 from contacting the lamps during insertion or removal of the can. Moreover, the body 2' prevents any refuse from penetrating into the housing 1 and/or from contaminating the panels 9 in the frame 2.

If the body 2' is omitted, the trash can 3 is preferably provided with a light-reflecting external surface or layer of metallic foil or the like to promote the illumination of advertising material 9' on the panels 9.

Unauthorized removal of the trash can 3 and/or panels 9 from the housing 1 is prevented by utilizing a suitable locking device, not shown, such as a locking bolt which secures the collar 3' to the top portion 1''' of the housing 1 and/or an analogous locking device which prevents detachment of the top portion 1''' from the intermediate portion 1' by vandals or other unauthorized persons. The locking device can be disengaged and/or removed from without by utilizing a key which is in possession of the person who is in charge of replacing the panels 9 and/or of emptying the trash can 3.

Figure 4:
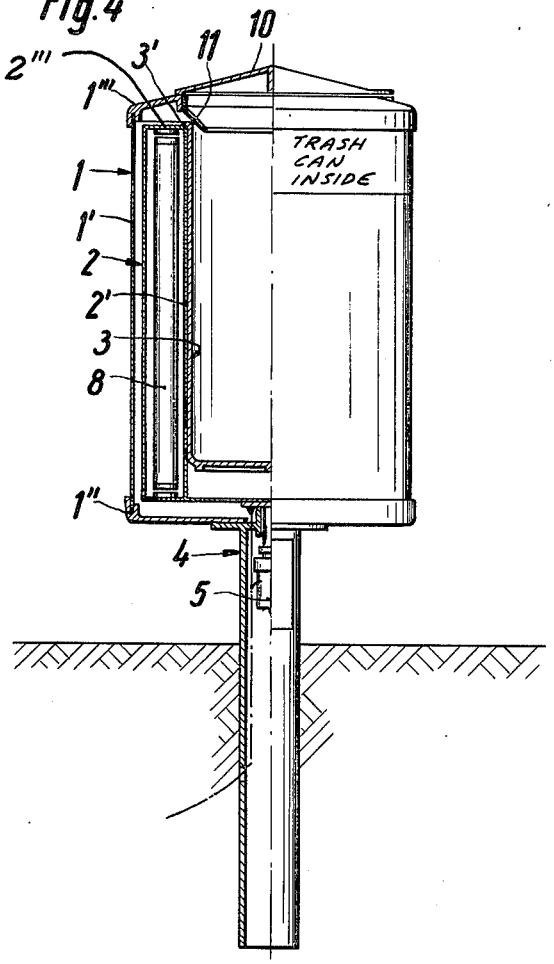
FIG. 4 is a partly elevational and partly central vertical sectional view of a second receptacle.
Figure 5:
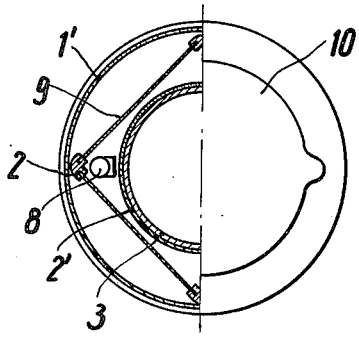
FIG. 5 is a partial plan and partial horizontal sectional view of the second receptacle.

The receptacle of FIGS. 4 and 5 differs from the receptacle of FIGS. 1 to 3 in that the collar 3' of the trash can 3 rests on a seat provided therefor on the top section 2''' of the frame 2 and that the top portion 1''' of the housing 1 has a funnel 11 which is located below the cover 10 and serves to direct refuse into the interior of the can 3. Moreover, the funnel 11 prevents refuse from falling into the space around the trash can. The seat on the top section 2''' of the frame 2 also serves as a means for centering the can 3 in the reflector 2'.

Figure 6:
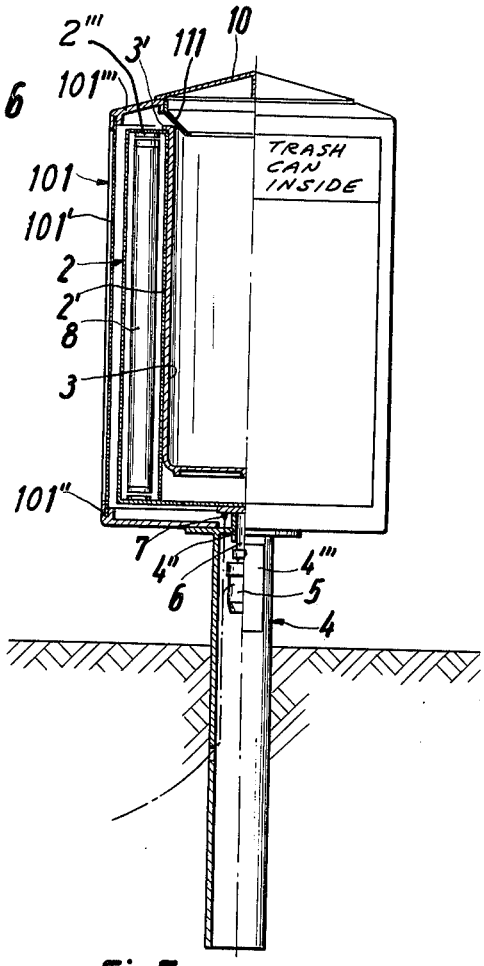
FIG. 6 is a partly elevational and partly central vertical sectional view of a third receptacle.
Figure 7:
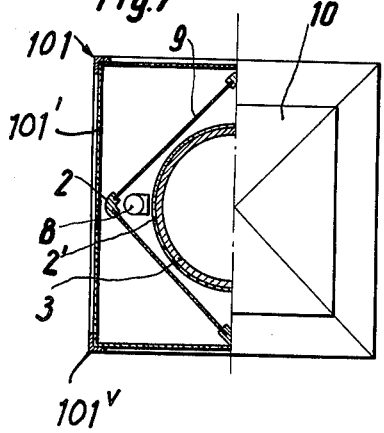
FIG. 7 is a partial plan and partial horizontal sectional view of the third receptacle.

The receptacle of FIGS. 6 and 7 comprises a housing 101 having a polygonal (preferably square) cross-sectional outline. This housing preferably also comprises a skeleton frame including the frame members 101$^{V}$ which hold panels or plates 101' consisting at least in part of light-transmitting material which is resistant to impacts and is preferably non-flammable. The top portion 101''' of the housing 101 comprises a funnel 111 which directs refuse into the trash can 3. The collar 3' of the trash can 3 rests on the top section 2''' of the frame 2. The bottom portion of the housing 101 is shown at 101''.

It is clear that each of the receptacles shown in FIGS. 4–5 and 6–7 can also be provided with suitable locking means to prevent unauthorized persons from gaining access to the trash can 3 and/or panels 9 in the frame 2.

Figure 8:
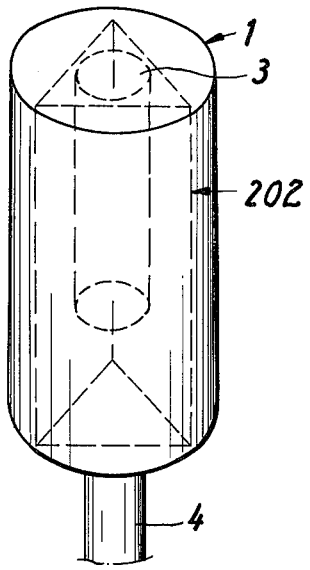
FIG. 8 is a fragmentary schematic perspective view of a receptacle which resembles the receptacles of FIGS. 1–3 and 4–5.

FIG. 8 shows schematically a receptacle with a substantially cylindrical housing 1 and a frame 202 having a triangular cross-sectional outline so that it can carry three discrete panels.

Figure 9:
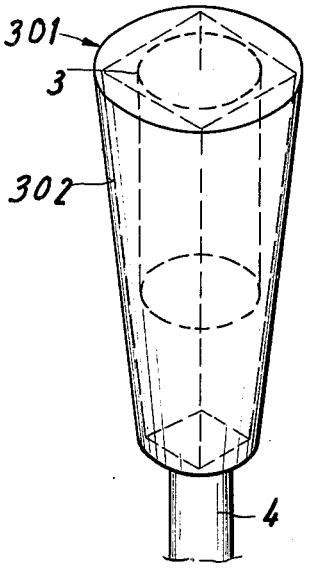
FIG. 9 is a schematic fragmentary perspective view of an inverted frustoconical receptacle.
Figure 10:
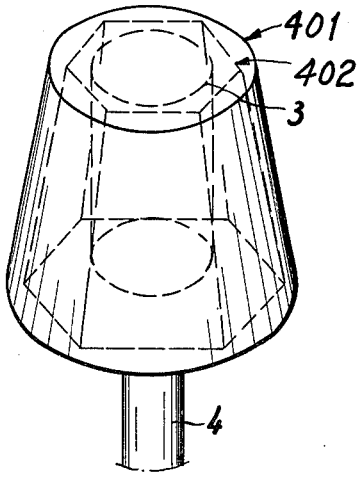
FIG. 10 is a schematic fragmentary perspective view of an upright frustoconical receptacle.

In FIG. 9, the housing 301 resembles the frustum of an inverted cone and the frame 302 resembles the frustum of an inverted four-sided pyramid. In FIG. 10, the housing 401 resembles the frustum of an upright cone and the frame 402 resembles the frustum of an upright six-sided pyramid. The frames 302 and 402 can respectively support four and six trapezoidal panels.

Figure 11:
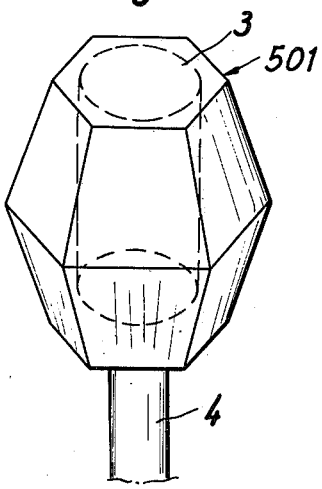
FIG. 11 is a schematic fragmentary perspective view of a receptacle which resembles a twin truncated pyramid.

FIG. 11 shows a housing 501 which resembles a twin truncated six-sided pyramid and receives a substantially cylindrical trash can 3. The frame is not shown; this frame can also resemble a twin truncated pyramid whereby the number of panels in each of its halves may but need not equal the number of sides on one-half of the housing 501. It is further clear that the housing 501 can receive a frame of the type shown in FIGS. 1–3, 6–7, 8 or 9, or a cylindrical frame. The number of different configurations for the housing, frame, reflector and/or trash can is practically limitless.

Additional advertising matter can be applied to the support 4, to the lid 10, and/or to the top portion of the housing. The term "advertising matter" is intended to embrace invitations to buy goods and/or services as well as educational material, information and/or directions for drivers, pedestrians, shoppers, pupils, employees and/or others.

If the panels 9 consist of opaque material, the illuminating means therefor is installed between the frame and the outer housing. Referring, for example, to FIGS. 6 and 7 and assuming that the panels 9 shown therein consist of an opaque material, the lamps 8 may be installed within and at the four corners of the housing 101. If the material of the panels 9 is transparent or translucent, the advertising material can be etched into the panels or can be pasted or otherwise applied to the front and/or rear side of each panel. In each instance, the outer housing constitutes a protective envelope which shields the panels against rain, sleet, snow, dust or soot as well as against vandals or thieves. The provision of illuminating means is desirable, the same as the provision of means for moving the frame with respect to the housing, in order to draw attention to the matter which is applied to the panels and to render such matter visible in daylight as well as at night.

It has been found that the improved receptacle can be used with particular advantage at street corners or elsewhere on sidewalks. Such receptacle can serve as a means for illuminating the corners, curbs and/or other parts of the streets which is of considerable help to handicapped and/or elderly persons in bad weather or at night. If the receptacle is mounted outdoors, the bottom portion of the housing (such as the bottom portion 1'' of FIG. 1) preferably also consists of light-transmitting material to provide additional illumination for the area adjacent to the support 4. A further advantage of the receptacle is that it serves the dual purpose of a depository for trash or other refuse as well as an advertising medium so that the advertising matter is less likely to be applied to buildings, lamp posts or the like where it would detract from the appearance of the street.

The panels can be removed, inspected, cleaned (if necessary), reinserted and/or replaced with a minimum of effort, with little loss in time, and without necessitating a complete dismantling of the receptacle. If desired, the support 4 can be replaced with a solid support of cylindrical cross-sectional outline or with a solid or tubular support of rectangular, square, hexagonal or other polygonal cross-sectional shape.

The housing and/or the panels of the improved receptacle may consist of a polyolefine, plexiglass or another material which exhibits a satisfactory resistance to impacts, permanent deformation, scratching and/or slitting and is preferably non-flammable. The material of the trash can 3 is preferably (but not necessarily) a synthetic plastic substance, such as polyvinyl chloride.

Finally, all component parts of the improved receptacle are preferably assembled by resorting to tongue-and-groove connections, bolts, screws or analogous fasteners which allow for rapid attachment or separation of cooperating parts. Also, the length of the support 4 preferably does not substantially exceed the length of the housing so that it can be stored in the housing during transport to a locale of use. The aforementioned readily separable connections render it possible to replace a damaged or defective component and to further utilize the remaining components of the receptacle.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended:

1. A combined trash receptacle and advertising medium, comprising a support including a hollow upright column; an outer housing stationarily mounted on said hollow column, at least a portion of said housing consisting of light-transmitting material; a trash can removably received in said outer housing and being spaced apart from said light transmitting portion; a frame rotatably mounted in said housing between said housing and said can; transparent advertising panels removably mounted on said frame behind said light-transmitting portion; means for illuminating said transparent advertising panels, said illuminating means being mounted on said frame between said panels and said can and comprising a plurality of upright fluorescent tubes; and means for rotating said frame in said housing and comprising an electric motor installed in said hollow column and conductor means extending through said column and arranged to connect said motor with an energy source.

2. A receptacle as defined in claim 1, and including reflector means interposed between said can and said illuminating means to direct light against the rear sides of said panels.

3. A receptacle as defined in claim 2, wherein said reflector means consists of aluminum foil.

4. A receptacle as defined in claim 1, wherein said housing has a cylindrical cross-sectional outline and said frame has a polygonal cross-sectional outline.

5. A receptacle as defined in claim 1, wherein said housing is a hollow cone and said frame is a hollow pyramid.

6. A receptacle as defined in claim 1, wherein said housing has a bottom portion secured to said support, a top portion spaced apart from said bottom portion, and an annular intermediate portion which connects said top and bottom portions and constitutes said light-transmitting portion.

7. A receptacle as defined in claim 1, and further comprising means for connecting said fluorescent tubes with said conductor means including at least one electric contact which rotates in said frame and is insulated against moisture.

8. A receptacle as defined in claim 1, wherein at least said portion of said housing consists of an impact-resistant non-flammable material.

9. A receptacle as defined in claim 8, wherein said material is taken from the group consisting of polyolefine, synthetic resin and plexiglass.

10. A receptacle as defined in claim 1, wherein said panels consist of an impact-resistant non-flammable material.

11. A receptacle as defined in claim 10, wherein said material is taken from the group consisting of polyolefine, synthetic resin and plexiglass.

12. A receptacle as defined in claim 1, wherein said can consists of synthetic plastic material, and has an open upper end provided with a collar, said housing having a top portion including a seat for said collar.

13. A receptacle as defined in claim 1, wherein said can consists of synthetic plastic material, and has an open upper end provided with a collar, said frame having a top section including a seat for said collar.

14. A receptacle as defined in claim 1, wherein said housing and said frame has a polygonal cross-sectional outline.

15. A receptacle as defined in claim 1, wherein said said frame is a hollow pyramid.

16. A receptacle as defined in claim 1, wherein said housing is a hollow cone.

17. A receptacle as defined in claim 1, wherein said can has an open top and said housing has a top portion provided with a cover which affords access to the open top of said can.

18. A receptacle as defined in claim 17, wherein said cover is pivotable with respect to said top portion of said housing between a closed position and at least one open position and is mounted on said housing for gravitational movement to said closed position.

19. A receptacle as defined in claim 18, wherein said housing has a cylindrical cross-sectional outline.

* * * * *